US007074094B2

(12) United States Patent
Kawahara et al.

(10) Patent No.: US 7,074,094 B2
(45) Date of Patent: Jul. 11, 2006

(54) COMPLIANT PIN AND ELECTRICAL CONNECTOR UTILIZING COMPLIANT PIN

(75) Inventors: Yuzo Kawahara, Kanagawa (JP); Hidehisa Yamagami, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/203,054

(22) Filed: Aug. 12, 2005

(65) Prior Publication Data

US 2006/0035535 A1 Feb. 16, 2006

(30) Foreign Application Priority Data

Aug. 12, 2004 (JP) ..... 2004-235286

(51) Int. Cl.
*H01R 13/42* (2006.01)

(52) U.S. Cl. ..... 439/751; 439/733.1

(58) Field of Classification Search ..... 439/751, 439/733.1, 82, 84, 78, 758, 759
See application file for complete search history.

(56) References Cited

U.S. PATENT DOCUMENTS

| | | | | |
|---|---|---|---|---|
| 4,186,982 | A * | 2/1980 | Cobaugh et al. | 439/82 |
| 4,606,589 | A * | 8/1986 | Elsbree et al. | 439/78 |
| 4,748,841 | A * | 6/1988 | Mezger et al. | 72/326 |
| 5,944,563 | A * | 8/1999 | Nagafuji | 439/751 |
| 5,980,271 | A * | 11/1999 | MacDougall et al. | 439/78 |
| 6,325,643 | B1 * | 12/2001 | Ohtsuki et al. | 439/82 |
| 2001/0021610 | A1 * | 9/2001 | Otsuki et al. | 439/751 |
| 2004/0259428 | A1 * | 12/2004 | Bleicher | 439/733.1 |

FOREIGN PATENT DOCUMENTS

JP 6-13735 1/1994

* cited by examiner

*Primary Examiner*—Tulsidas C. Patel
*Assistant Examiner*—Vladimir Imas
(74) *Attorney, Agent, or Firm*—Barley Snyder LLC

(57) ABSTRACT

A compliant pin comprises a contact portion, an end portion, and a press-fit portion. The press-fit portion is arranged between the contact portion and the end portion. The press-fit portion is deformable in a radial direction. The press-fit portion has a first tapered surface with a first end and a second end. The first tapered surface has recesses for receiving shavings generated when the compliant pin is press-fit.

23 Claims, 5 Drawing Sheets

COMPLIANT PIN AND ELECTRICAL CONNECTOR UTILIZING COMPLIANT PIN

FIELD OF THE INVENTION

The invention relates to a compliant pin provided with recesses for receiving shavings formed when the compliant pin is press-fit into a compliant pin receiving aperture in a circuit board and an electrical connector using the same.

BACKGROUND OF THE INVENTION

Compliant pins are slightly elastically deformable in a radial direction. When press-fit portions of the compliant pins are pressed into compliant pin receiving apertures of a circuit board, because the compliant pin receiving apertures have slightly smaller diameters than the compliant pins, the compliant pins are fixed to the circuit board due to elastic deformation. Favorable electrical connections can thereby be established without soldering.

Inner surfaces of the compliant pin receiving apertures are generally plated with a material, such as copper. The compliant pins are generally plated across their entire surfaces with a material, such as tin. Because the plating of the compliant pins is usually softer than the plating of the compliant pin receiving apertures, shavings of the plating of the compliant pins are generally generated during press-fitting of the compliant pins into the compliant pin receiving apertures due to frictional contact between the compliant pins and the compliant pin receiving apertures. The shavings may be scattered on the circuit board and therefore there is a possibility that the scattered shavings will short printed circuits on the circuit board or electronic components provided thereon.

Japanese Unexamined Patent Publication No. 6(1994)-013735 discloses a technique for solving the above-mentioned problem. In this technique, a plastic film is laminated on both sides of a circuit board, and the compliant pin is then press-fitted into compliant pin receiving apertures of the circuit board. When the compliant pin is press-fit, the compliant pin penetrates the plastic film, and the plastic film surrounds the compliant pin in a state of close contact. The shavings generated during insertion are thereby sealed within the compliant pin receiving apertures of the circuit board and scattering of the shavings on the circuit board is prevented.

In another known technique, a damp proofing coating for protecting electronic components is provided on both sides of a circuit board into which compliant pins are press-fit. During press-fitting, the shavings are coated along with the electronic components so that there is no possibility that the shavings will scatter. However, the coating is not necessarily administered for all circuit boards.

Both of these techniques have the disadvantage that they require an addition component and an additional manufacturing step. In the technique disclosed in Japanese Unexamined Patent Publication No. 6(1994)-013735, the plastic film for laminating the circuit board is a separate component and a laminating step is required. In the other technique, additional coating materials and a coating step is required. Thus, the costs of manufacturing are increased and the manufacturing process is more difficult in the above-mentioned techniques.

SUMMARY OF THE INVENTION

It is an object of the invention to provide a compliant pin that is press-fit into a compliant pin receiving aperture of a circuit board wherein the amount of shavings that scatter on the circuit board is reduced without increasing the number of components or manufacturing steps and an electrical connector using the same. It is further an object of the invention to provide a compliant pin that is press-fit into a compliant pin receiving aperture of a circuit board wherein shavings generated from the press-fitting are miniaturized so that shorting among circuits on the circuit board and among electronic devices in prevented and an electrical connector using the same.

This and other objects are achieved by a compliant pin comprising a contact portion, an end portion, and a press-fit portion. The press-fit portion is arranged between the contact portion and the end portion. The press-fit portion is deformable in a radial direction. The press-fit portion has a first tapered surface with a first end and a second end. The first tapered surface has recesses for receiving shavings generated when the compliant pin is press-fit.

This and other objects are further achieved by an electrical connector assembly comprising an electrical connector and at least one compliant pin. The compliant pin including a press-fit portion arranged between a contact portion and an end portion. The press-fit portion is deformable in a radial direction. The press-fit portion has a first tapered surface with a first end and a second end. The first tapered surface has recesses for receiving shavings generated when the compliant pin is press-fit into a compliant pin receiving aperture.

DETAILED DESCRIPTION OF THE INVENTION

FIGS. 1A–3B show a compliant pin 1 according to the invention. The compliant pin 1 is substantially pin-shaped and is formed, for example, by stamping a single metal plate. The compliant pin 1 may be formed, for example, from an alloy, such as copper, so that the compliant pin 1 has conductive properties. The alloy may then be plated with a first plating material, such as nickel. A second plating material, such as tin, may then be administered over the first plating material.

The thickness of the first and second plating materials may be, for example, 08 μm to 1.5 μm. It will be appreciated by those skilled in the art, however, that the first and second plating materials may be any metal that has conductive properties and is corrosion resistant, such as gold.

Figure 1A:
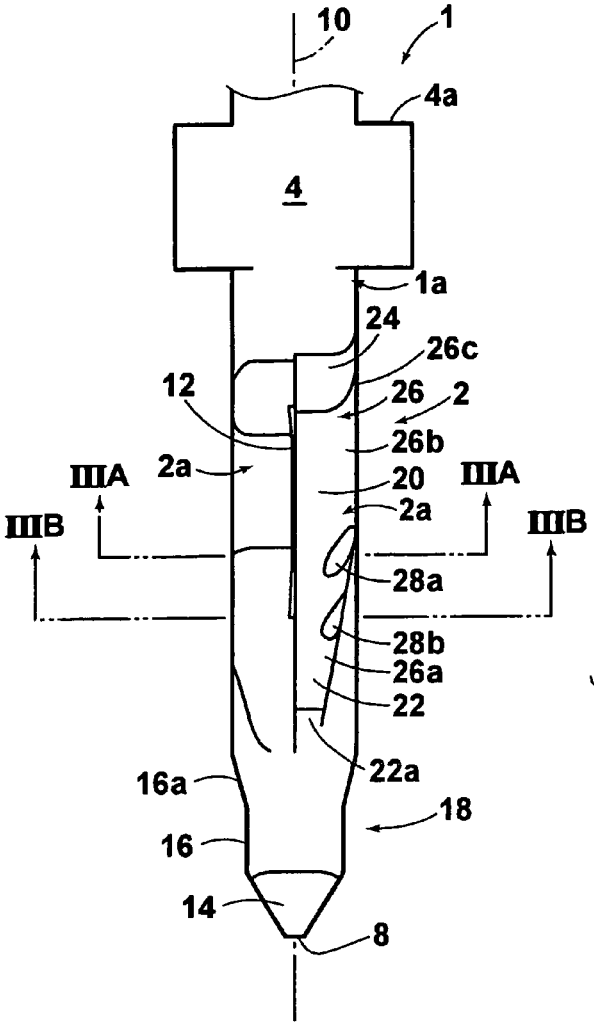
FIG. 1A is a plan view of a compliant pin according to the invention.
Figure 1B:
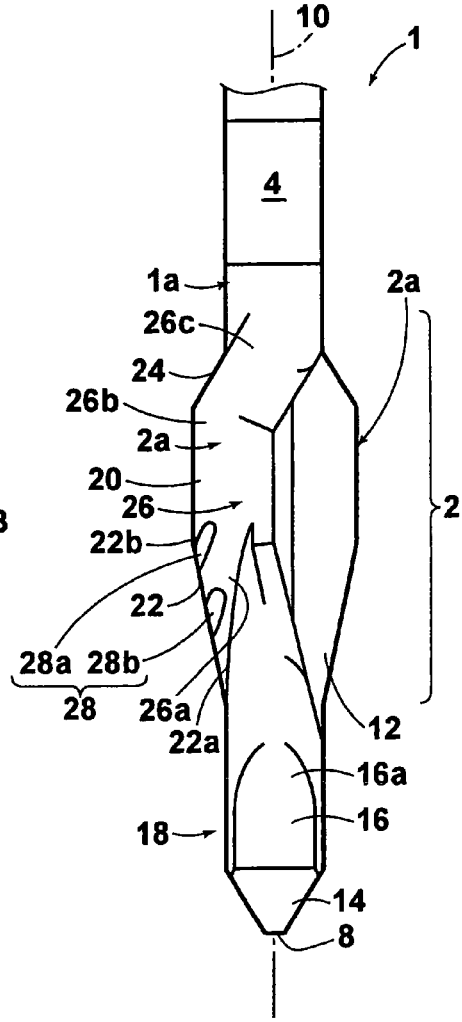
FIG. 1B is a side view of the compliant pin.
Figure 1C:
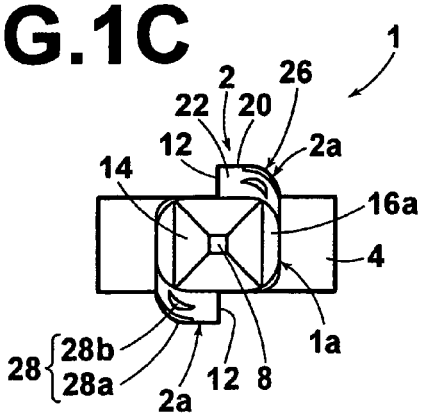
FIG. 1C is a front view of the compliant pin.
Figure 2A:
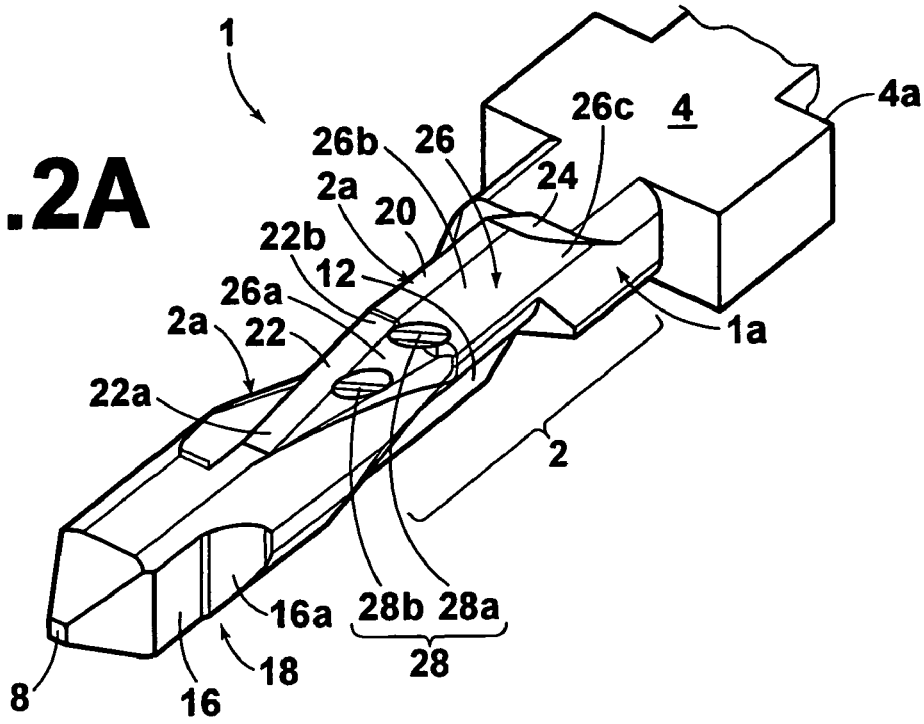
FIG. 2A is a first perspective view of the compliant pin.
Figure 2B:
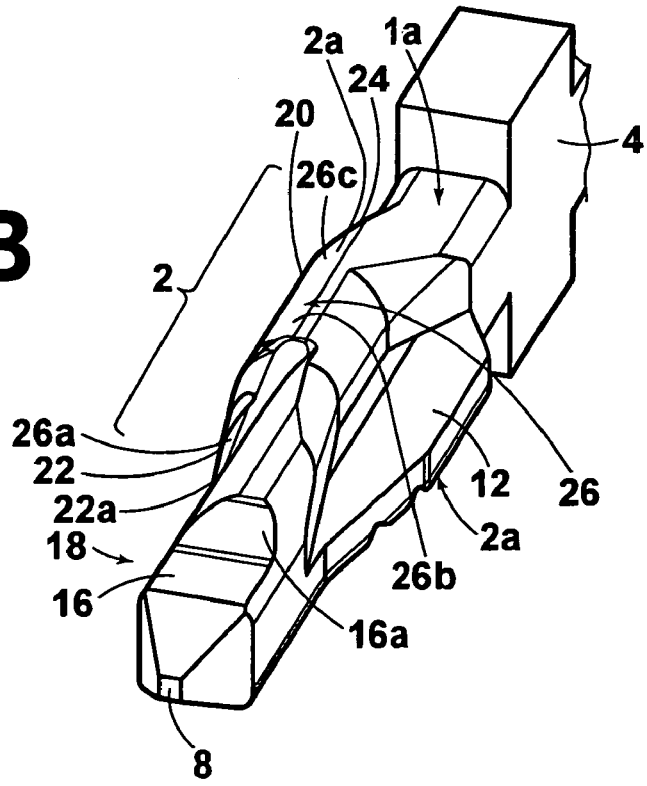
FIG. 2B is a second perspective view of the compliant pin.
Figure 4:
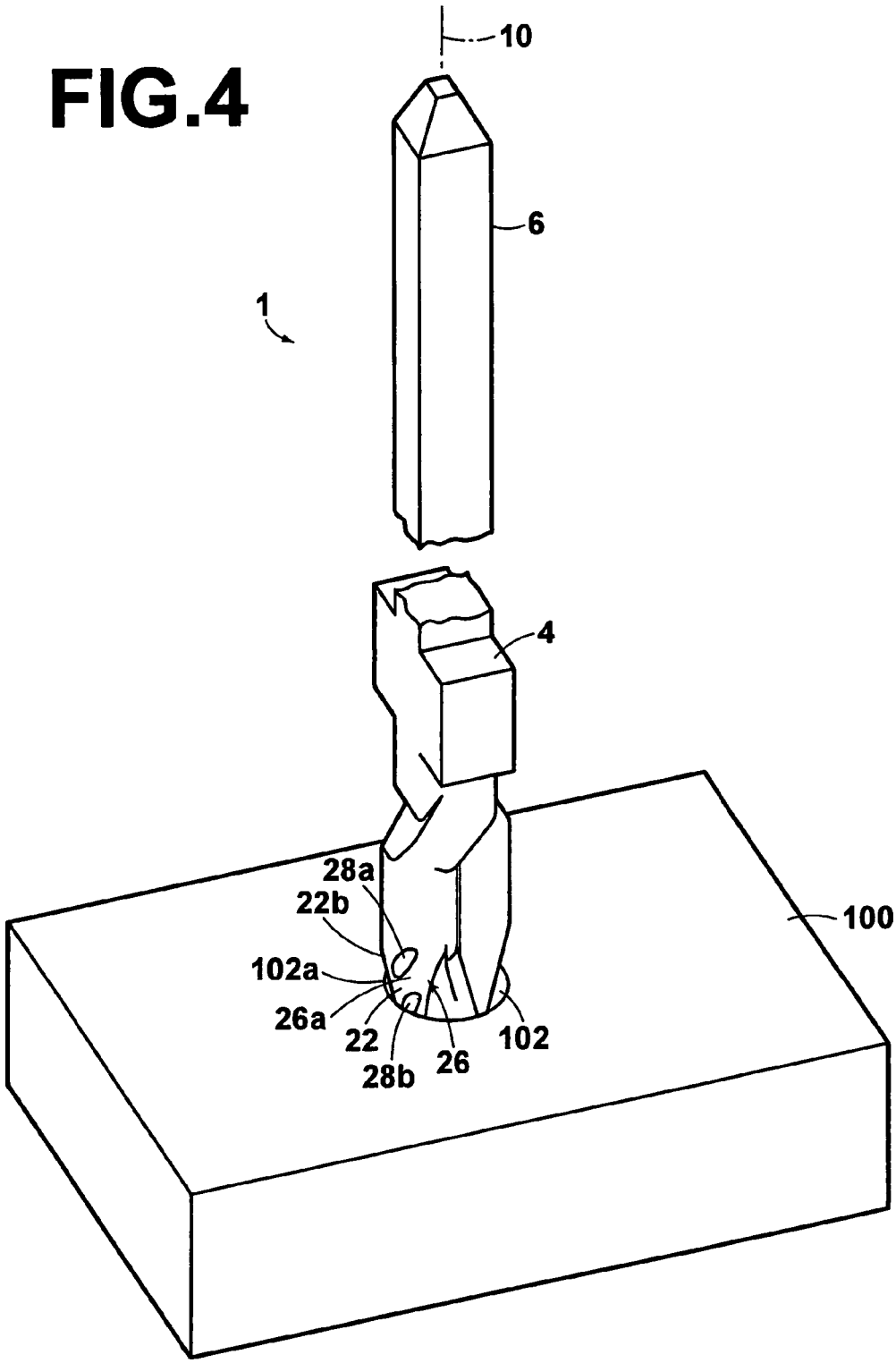
FIG. 4 is a perspective view of the compliant pin shown during an initial stage of press-fitting the compliant pin into a compliant pin receiving aperture of a circuit board.

As shown in FIGS. 2A–2B and 4, the compliant pin 1 has a substantially rectangular cross-section and comprises a press-fit portion 2, a pressing portion 4, a contact portion 6, and an end portion 18. As shown in FIGS. 1A–1B, the press-fit portion 2 is formed, for example, by pressing a main body 1*a* of the compliant pin 1 in opposite directions in a direction that perpendicularly intersects a central axis 10 of the compliant pin 1 such that partial shearing occurs and the sheared portions swell in opposite directions from each other. The press-fit portion 2 is sheared in a direction that perpendicularly intersects a long side of the rectangular cross-section. The press-fit portion 2 has a slight elasticity in a radial direction (direction along a plane of the sheared surfaces).

Figure 3A:
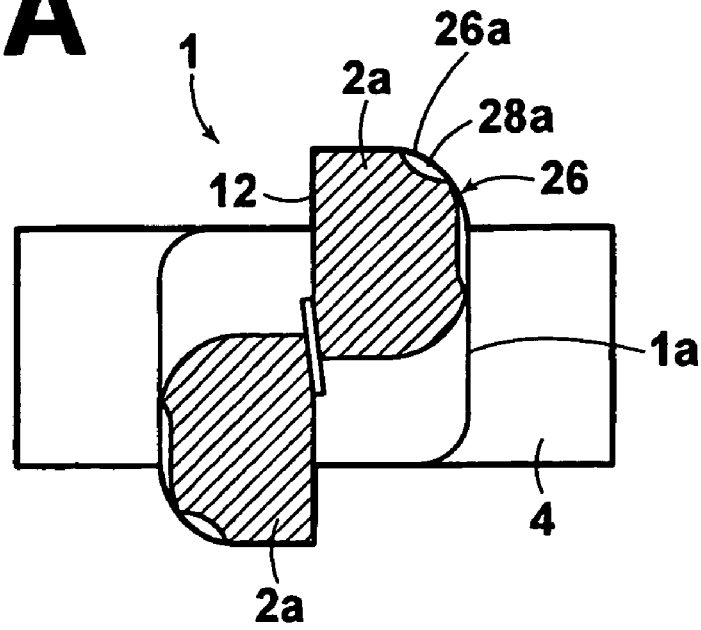
FIG. 3A is a magnified sectional view taken along line IIIA—IIIA of FIG. 1A.
Figure 3B:
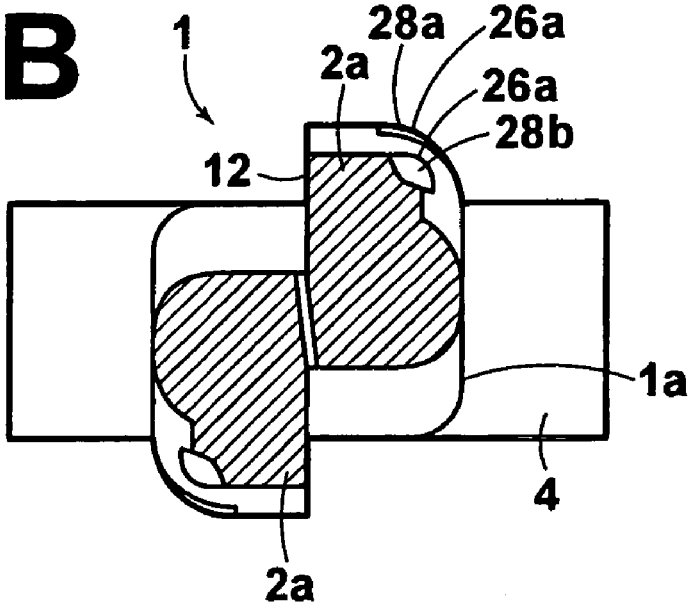
FIG. 3B is a magnified sectional view taken along line IIIB—IIIB of FIG. 1A.

The press-fit portion 2 includes projecting portions 2*a*, as shown in FIGS. 3A–3B. The projecting portions 2*a* have sheared surfaces 12 on one side thereof and are formed by the shearing operation. Each of the projecting portions 2*a* has substantially the same shape and is substantially symmetrical with respect to the central axis 10. Exterior surfaces 20 are formed furthest toward an exterior of the compliant pin 1 and extend substantially parallel to the central axis 10. First tapered surface 22 extend from the exterior surfaces 20 and incline toward the end portion 18. The first tapered surface 22 have a first end 22*a* and a second end 22*b*. Second tapered surfaces 24 are formed at sides of the exterior surfaces 20 opposite the first tapered surface 22.

The exterior surfaces 20, the first tapered surface 22, and the second tapered surfaces 24 have substantially arcuate outer surfaces 26. The arcuate outer surfaces 26 consist of first, second, and third arcuate outer surfaces 26*a*, 26*b*, 26*c*, respectively. The arcuate outer surfaces 26 are formed toward an outside of the sheared surfaces 12 and have a substantially arcuate configuration that conform to an arc of compliant pin receiving aperture 102 in a circuit board 100, as shown in FIG. 4.

Between the first end 22*a* and the second end 22*b* of the first tapered surface 22 are recesses 28. As shown in FIGS. 3A–3B, the recesses 28 consist of a first recess 28*a* and a second recess 28*b*. The recesses 28 are formed in the first arcuate outer surface 26*a*. The first recess 28*a* is formed in a vicinity of the second end 22*b*, and the second recess 28*b* is formed between the first recess 28*a* and the first end 22*a*. Each of the recesses 28 is formed diagonally with respect to the central axis 10 of the compliant pin 1 and is inclined away from the sheared surfaces 12. The recesses 28 are formed simultaneously with the projecting portions 2*a*, when the projecting portions 2*a* are formed by a pressing machine. Although only two of the recesses 28 are shown in the illustrated embodiment and described herein, it will be appreciated by those skilled in the art that the number of the recesses 28 can be increased or decreased depending on the size and shape of the compliant pin 1.

As shown in FIGS. 1A–1B, the pressing portion 4 is formed adjacent to the press-fit portion 2. The pressing portion 4 has a substantially parallelepiped shape and a substantially rectangular cross section that extends in the same direction as that of the main body 1*a*. The pressing portion 4 has pressing surfaces 4*a* formed toward a rear of the pressing portion 4 and on both sides thereof.

As shown in FIGS. 1A–2A, the end portion 18 has a substantially square cross-section and includes substantially flat guide surfaces 16 formed continuously with tapered guide surfaces 14. The tapered guide surfaces 14 converge at a tip 8. Inclined surfaces 16*a* extend from the flat guide surfaces 16 and cause the cross-section of the compliant pin 1 to increase toward the main body 1*a*.

FIG. 4 shows the circuit board 100. The circuit board 100 has the compliant pin receiving aperture 102. An inner surface and edges 102*a* of the compliant pin receiving aperture 102 may be plated with a metal material, such as copper.

A method of press-fitting the compliant pin 1 into the compliant pin receiving aperture 102 of the circuit board 100 will now be described. As shown in FIG. 4, during an initial stage of press-fitting the compliant pin 1 into the compliant pin receiving aperture 102, the press-fit portion 2 is not in elastic contact with the circuit board 100. To press-fit the end portion 18 of the compliant pin 1 into the compliant pin receiving aperture 102, the pressing surfaces 4*a* of the pressing portion 4 are pressed downward. The first arcuate outer surfaces 26*a* of the first tapered surface 22 frictionally contact the edge 102*a* of the compliant pin receiving aperture 102. The plating of the compliant pin 1 peels-off along a direction of insertion due to frictional contact between the compliant pin 1 and the edges 102*a* of the compliant pin receiving aperture 102. Because the plating is relatively soft, especially when tin plating is used, the plating is easily removed during insertion of the compliant pin 1 into the compliant pin receiving aperture 102, which reduces insertion resistance.

As the compliant pin 1 is inserted further, the first tapered surface 22 serve as guide surfaces. The plating of the first tapered surface 22 peels-off along the central axis 10 and shavings of the plating before the second recess 28*b* are received in the second recess 28*b*. The plating between the second recess 28*b* and the first recess 28*a* also peel-off during further insertion. These peeled-off shavings are received in the first recess 28*a*. Because the recesses 28 are formed diagonally with respect to the central axis 10 of the compliant pin 1 and are inclined away from the sheared surfaces 12, the recesses 28 do not engage and/or score the edges 102*a* of the compliant pin receiving apertures 102, when the compliant pin 1 is pressed therein. The arcuate outer surfaces 26 secure the compliant pin 1 in the compliant pin receiving apertures 102, and the shavings from the plating are housed within the recesses 28.

Because the shavings are mostly generated at the first tapered surface 22, in order to prevent the shavings from scattering, it is necessary to provide the first recess 28*a* at least at the second ends 22*b* of the first tapered surface 22. Thus, the relatively large shavings generated from the first ends 22*a* to the second ends 22*b* of the first tapered surface 22 are housed in the first recess 28*a*. The second recess 28*b* are formed between the first recess 28*a* and the first ends 22*a* of the taper surfaces 22, so that the peeled-off shavings are divided by length into those having lengths between the first ends 22*a* of the taper surfaces 22 to the recess 28*b* and those having lengths between the second recess 28*b* and the first recess 28*a*. The shavings are thereby miniaturized and become easier to house within the recesses 28. In addition, by miniaturizing the shavings, even in the case where the shavings become scattered outside of the compliant pin receiving aperture 102, the possibility that the shavings will cause short circuits and the like is reduced. Further, by the presence of the second recess 28*b*, the contact surface area between the first tapered surface 22 and the compliant pin receiving aperture 102 decreases thereby reducing the amount of shavings generated.

Figure 5:
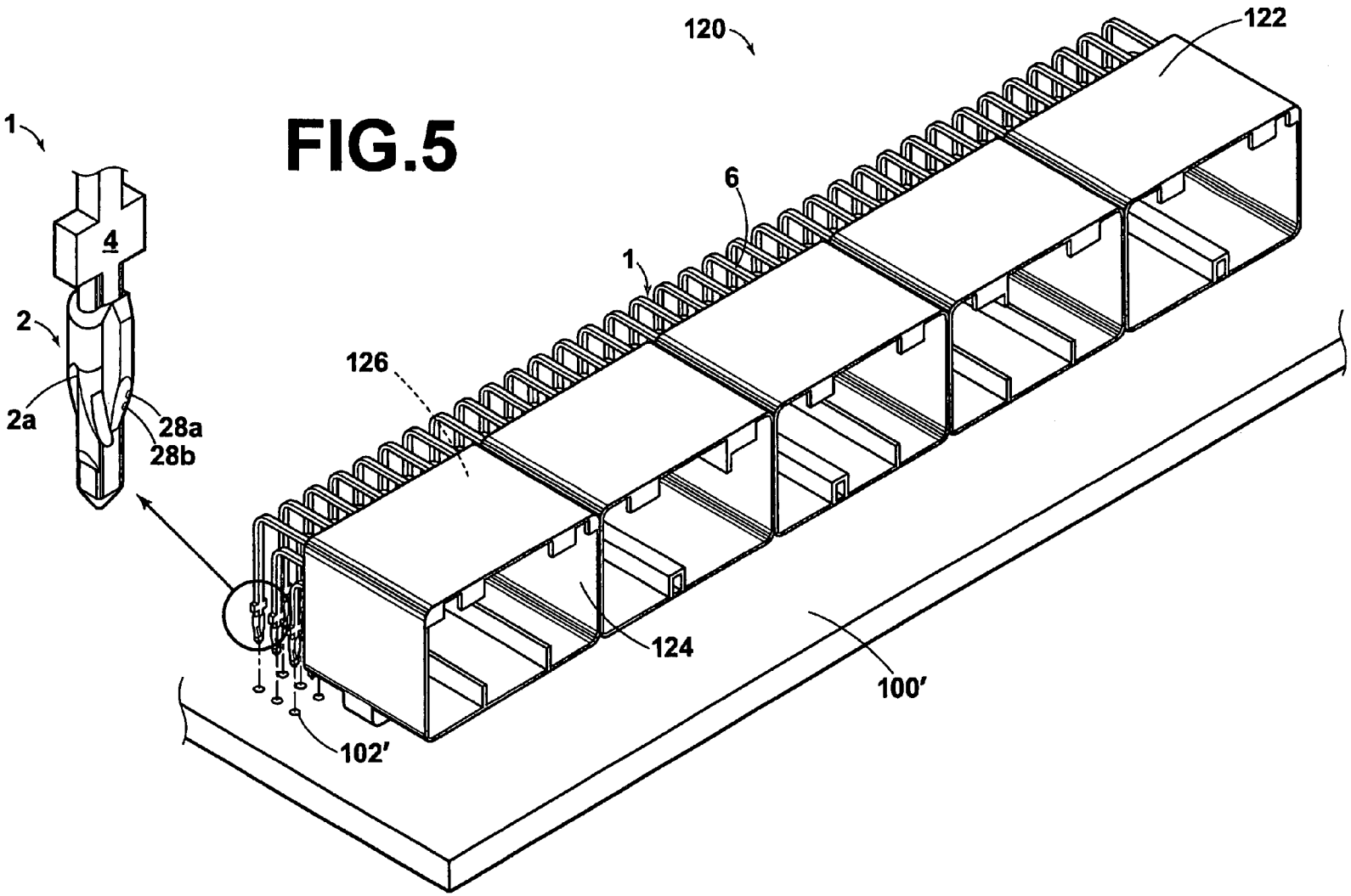
FIG. 5 is a perspective view of an electrical connector that is provided with a plurality of the compliant pins.

FIG. 5 shows an electrical connector 120 provided with the compliant pin 1. The connector 120 comprises an insulating housing 122 having an engaging recess 124 that opens toward a front thereof. A plurality of the compliant pins 1 is mounted in a rear wall 126 of the housing 122. The contact portions 6 of the compliant pins 1 are bent at a substantially right angle and protrude toward an interior of the engaging recess 124. The contact portions 6 serve as electrical contact points with a mating connector (not shown). The connector 120 is mounted onto a circuit board 100' by press-fitting the compliant pins 1 into compliant pin receiving apertures 102' formed in the circuit board 100'. The press-fit portions 2 of the compliant pins 1 are arranged such that the projecting portions 2*a* are aligned perpendicular to a longitudinal direction of the housing 122.

The foregoing illustrates some of the possibilities for practicing the invention. Many other embodiments are possible within the scope and spirit of the invention. For example, the shape and size of the connector 120, as well as the number of the compliant pins 1 accommodated therein can be varied. Additionally, in the above described embodiment, the plating of the compliant pin 1 peels-off because the plating is softer than that of the compliant pin receiving aperture 102. In addition or alternatively, the plating of the compliant pin receiving aperture 102 can peel-off and be received within the recesses 28. It is, therefore, intended that the foregoing description be regarded as illustrative rather than limiting, and that the scope of the invention is given by the appended claims together with their full range of equivalents.

We claim:

1. A compliant pin, comprising:

a contact portion;

an end portion; and a press-fit portion arranged between the contact portion and the end portion, the press-fit portion being deformable in a radial direction, the press-fit portion having a first tapered surface with a first end and a second end, the first tapered surface being formed to frictionally contact an edge of a compliant pin receiving aperture, the first tapered surface having recesses for receiving shavings generated when the compliant pin is press-fit in the compliant pin receiving aperture.

2. The compliant pin of claim 1, wherein the recesses include a first recess and a second recess, the first recess is formed in a vicinity of the second end and the second recess is formed between the first recess and the first end.

3. The compliant pin of claim 1, wherein the recesses extend diagonally with respect to a central axis of the compliant pin.

4. The compliant pin of claim 1, wherein the press-fit portion includes sheared surfaces and the recesses are inclined away from the sheared surfaces.

5. The compliant pin of claim 1, wherein the first tapered surface has a substantially arcuate outer surface.

6. The compliant pin of claim 1, wherein the end portion includes tapered guide surfaces that converge at a tip.

7. The compliant pin of claim 1, further comprising a pressing portion.

8. The compliant pin of claim 1, wherein the compliant pin is plated with a first plating material.

9. The compliant pin of claim 8, wherein the first plating material is copper.

10. The compliant pin of claim 8, wherein the first plating material is plated with a second plating material.

11. The compliant pin of claim 10, wherein the second plating material is nickel.

12. An electrical connector assembly, comprising:

an electrical connector having at least one compliant pin;

the compliant pin having a press-fit portion arranged between a contact portion and an end portion, the press-fit portion being deformable in a radial direction, the press-fit portion having a first tapered surface with a first end and a second end, the first tapered surface being formed to frictionally contact an edge of a compliant pin receiving aperture, the first tapered surface having-recesses for receiving shavings generated when the compliant pin is press-fit in the compliant pin receiving aperture.

13. The electrical connector assembly of claim 12, wherein the recesses include a first recess and a second recess, the first recess is formed in a vicinity of the second end and the second recess is formed between the first recess and the first end.

14. The electrical connector assembly of claim 12, wherein the recesses extend diagonally with respect to a central axis of the compliant pin.

15. The electrical connector assembly of claim 12, wherein the press-fit portion includes sheared surfaces and the recesses are inclined away from the sheared surfaces.

16. The electrical connector assembly of claim 12, wherein the first tapered surface has a substantially arcuate outer surface.

17. The electrical connector assembly of claim 12, wherein the end portion includes tapered guide surfaces that converge at a tip.

18. The electrical connector assembly of claim 12, further comprising a pressing portion.

19. The electrical connector assembly of claim 12, wherein the compliant pin is plated with a first plating material.

20. The electrical connector assembly of claim 19, wherein the first plating material is copper.

21. The electrical connector assembly of claim 19, wherein the first plating material is plated with a second plating material.

22. The electrical connector assembly of claim 21, wherein the second plating material is nickel.

23. The electrical connector assembly of claim 12, wherein the compliant pin receiving aperture is plated.

* * * * *